US011897017B2

(12) United States Patent
Avrillaud et al.

(10) Patent No.: US 11,897,017 B2
(45) Date of Patent: Feb. 13, 2024

(54) HYBRID FORMING METHOD AND CORRESPONDING FORMING DEVICE

(71) Applicant: ADM28 s.àr.l, Luxembourg (LU)

(72) Inventors: Gilles Avrillaud, Pinsaguel (FR); Fabrice Beguet, Aucamville (FR)

(73) Assignee: ADM28 S.ÀR.L, Luxembourg (LU)

( * ) Notice: Subject to any disclaimer, the term of this patent is extended or adjusted under 35 U.S.C. 154(b) by 70 days.

(21) Appl. No.: 17/430,663

(22) PCT Filed: Feb. 11, 2020

(86) PCT No.: PCT/FR2020/050247

§ 371 (c)(1),
(2) Date: Aug. 12, 2021

(87) PCT Pub. No.: WO2020/165538

PCT Pub. Date: Aug. 20, 2020

(65) Prior Publication Data

US 2022/0126350 A1 Apr. 28, 2022

(30) Foreign Application Priority Data

Feb. 13, 2019 (FR) ..... 1901446

(51) Int. Cl.
*B21D 26/12* (2006.01)

(52) U.S. Cl.
CPC ..... *B21D 26/12* (2013.01)

(58) Field of Classification Search
CPC ..... B21D 26/12; B21D 26/06; B21D 26/02; B21D 26/031; B21D 22/205
See application file for complete search history.

(56) References Cited

U.S. PATENT DOCUMENTS 4,225,553 A * 9/1980 Hirota ..... B21D 24/06 425/398
7,802,457 B2 9/2010 Golovashchenko et al.
2008/0264131 A1 10/2008 Luckey et al.
2011/0088442 A1 4/2011 Golovashchenko
2012/0103045 A1 5/2012 Golovashchenko

FOREIGN PATENT DOCUMENTS

DE 100 19 594 A1 10/2001

* cited by examiner

*Primary Examiner* — Teresa M Ekiert
(74) *Attorney, Agent, or Firm* — Seed IP Law Group LLP

(57) ABSTRACT

A hybrid method for forming a material blank includes placing a material blank to be deformed between a die and a blank-holder. The material blank is deformed by stamping using at least one punch in order to obtain a pre-stamped material blank. A cavity, wherein, on one hand, the at least one punch having pre-stamped the material blank and, on the other, at least one pair of electrodes are located, is filled with liquid. The pre-stamped material blank is placed in contact with the liquid of the cavity, and at least one electrical discharge is generated between the at least one pair of electrodes in such a way as to deform the pre-stamped material blank against the die.

12 Claims, 3 Drawing Sheets

HYBRID FORMING METHOD AND CORRESPONDING FORMING DEVICE

BACKGROUND

Technical Field

The present disclosure relates to a hybrid method for forming a sheet and a corresponding forming device.

Description of the Related Art

There are numerous methods for forming a sheet to give it a more or less complex shape. The sheet can for example be bent, rolled, stamped, etc.

By way of method for deforming a sheet, electrohydraulic forming is known which deforms a sheet against a mould by applying a dynamic pressure. For this purpose, an electrical discharge is generated between at least two electrodes in a cavity filled with liquid, for example water. An electric arc is then formed between the two electrodes inducing a high temperature gradient and vaporisation of the liquid. A pressure wave, also commonly known as a "shock wave", moves at high speed and presses the sheet against the mould. Electrohydraulic forming is particularly advantageous compared with other forming methods since it makes it possible to have a reduced elastic return and obtain enhanced etching type details and/or square edges and/or elongations before break on the parts to be formed.

In some cases, particularly when the parts to be formed are particularly deep, several successive electrical discharges can be carried out. In order to reduce the number of successive electrical discharges required and thus limit the forming time of a part, it has been proposed to carry out a hydraulic preforming step before the electrohydraulic forming of the part. To do this, the cavity is filled with pressurised liquid as described for example in the document U.S. Pat. No. 7,802,457 B2. When the liquid pressure is sufficient, the sheet is partially deformed against the mould. Electrical discharges are then generated to induce shock waves and complete the forming of the part until the desired shape is achieved.

Preforming the part by applying a quasi-static pressure makes it possible to promote the descent of the sheet in the mould, therefore to reduce the deformation of the material to be carried out by electrohydraulic forming and therefore reduce the forming time should it be necessary to recharge the high-voltage electrical pulse generator between two discharges or reduce the size of the generator should it be sought to carry out successive discharges without having to wait between the discharges for the generator to recharge.

With these methods, it is however difficult to produce parts with vertical walls, i.e. walls extending perpendicularly to the plane of the sheet before the deformation thereof. To be able to produce such vertical walls, very high pressures should be used.

The document US2011/0088442 relates to a hydromechanical forming tool that may include electrohydraulic forming chambers in which an electrical discharge can be induced by electrodes in order to improve the level of the detail which can be produced in a mould.

The document DE 10019594 relates to a method and a device for the hydromechanical deformation of plastically deformable sheets, in particular for producing motor body parts, wherein the sheet is placed between a forming tool and a liquid buffer and wherein under the effect of a static pressure created in the liquid buffer, the sheet is pressed against the forming tool. Simultaneously to the application of the static pressure, a shock wave generator disposed in the liquid buffer is activated to locally create an increased pressure force oriented towards zones of the sheet.

The document US2012/103045 shows for its part a system for the electrohydraulic forming of a sheet in an electro-hydroforming machine.

BRIEF SUMMARY

The present disclosure provides a method and a corresponding device which makes it possible to produce simply, using electro-hydroforming, vertical walls.

To this end, the present disclosure proposes a hybrid method for forming a material blank wherein:

- the material blank to be deformed is placed between a die and a blank-holder,
- the material blank is deformed by stamping using at least one punch in order to obtain a pre-stamped material blank.

According to the present disclosure, the following steps are also provided:

- a cavity, wherein, on one hand, said at least one punch and, on the other, at least one pair of electrodes are located, is filled with liquid,
- the pre-stamped material blank is placed in contact with the liquid of the cavity, and
- at least one electrical discharge is generated between at least one pair of electrodes in such a way as to deform the material blank against the die.

This method makes it possible to favour the descent of the material into the die while offering the possibility of creating so-called vertical walls using the punch and also having a high-quality finish of the part thanks to the electro-hydroforming.

According to a first alternative embodiment, the relative travel of each punch with respect to the die is limited in such a way that the material blank when pushed by the punch(es) does not come into contact with the die.

According to a further alternative embodiment, the relative travel of at least one punch with respect to the die is such that the material blank when pushed by said at least one punch comes into contact with the die.

To further enhance the finish quality of the part produced and facilitate the adjustment of the tools by limiting the manual reworking of the punch, the hybrid method described above can further include a step during which the liquid in contact with the material blank is pressurised so as to deform the pre-stamped material blank. A hydroforming step is then carried out which is preferably carried out after the deformation by the punch and before the electro-hydroforming.

So as not to be impeded by the air remaining lodged between the material blank and the die, it can be advantageously arranged to create a negative pressure between the material blank and the die.

In order to concentrate the shock waves created by the electrical discharges, it has been observed that it is preferable to have a relatively great proximity of the punch with the material blank during the electro-hydroforming. Thus, it is arranged preferably to only move the at least one punch away from the die after having carried out at least one electrical discharge.

The present disclosure also proposes a device for implementing the hybrid formation method described above. It thus proposes a hybrid material blank forming device comprising:

a die cooperating with a blank-holder, the die being movable relative to the blank-holder between a so-called open position wherein the material blank can be positioned between the die and the blank-holder and be removed therefrom, and another so-called closed position wherein the blank-holder cooperates with the die to hold in a controlled manner the entire edge of a material blank to be deformed, a tank defining a cavity capable of being filled with a liquid, at least two electrodes placed in the cavity, wherein the tank includes at least one movable punch relative to an assembly formed by the blank-holder and the die in the closed position between a so-called far position wherein the free end of the punch is at a distance from the die and a so-called near position wherein the free end of the punch is at a distance from the die less than the distancing distance in the far position.

In this structure, the die makes it possible to define the final shape of the sheet to be deformed. The punch is arranged to be disposed in the cavity and to deform the sheet in the direction of the die by coming into contact with said sheet and by deforming it.

In a preferred alternative embodiment of such a hybrid forming device, the assembly formed by the blank-holder and the die in the closed position is movable with respect to the tank which remains stationary.

In this hybrid forming device, it can also be arranged that the tank has a bottom and a peripheral wall, and that the free edge of the peripheral wall forms a punch. Here the tank and the at least one punch are preferably a single part.

In the cases where the tank has a bottom and a peripheral wall, then it can be arranged that at least one punch is produced on a free edge of a wall extending through the tank by dividing the latter into at least two compartments, and that at least one pair of electrodes is located in each of the two compartments.

A preferred alternative embodiment of a device described above provides that the blank-holder is attached to vertical stays, that the die is movably mounted in translation with respect to the blank-holder on the side opposite the stays, that the tank includes a bottom and a peripheral wall, and that the tank is fixedly mounted whereas the stays are sliding with respect to the tank. These stays can be mounted for example on hydraulic buffers. These stays can also be formed for example by a gas spring, a hydraulic cylinder or similar.

BRIEF DESCRIPTION OF THE DRAWINGS

Details and advantages of the present disclosure will emerge more clearly from the following description, with reference to the appended schematic drawing wherein.

DETAILED DESCRIPTION

Figure 1:
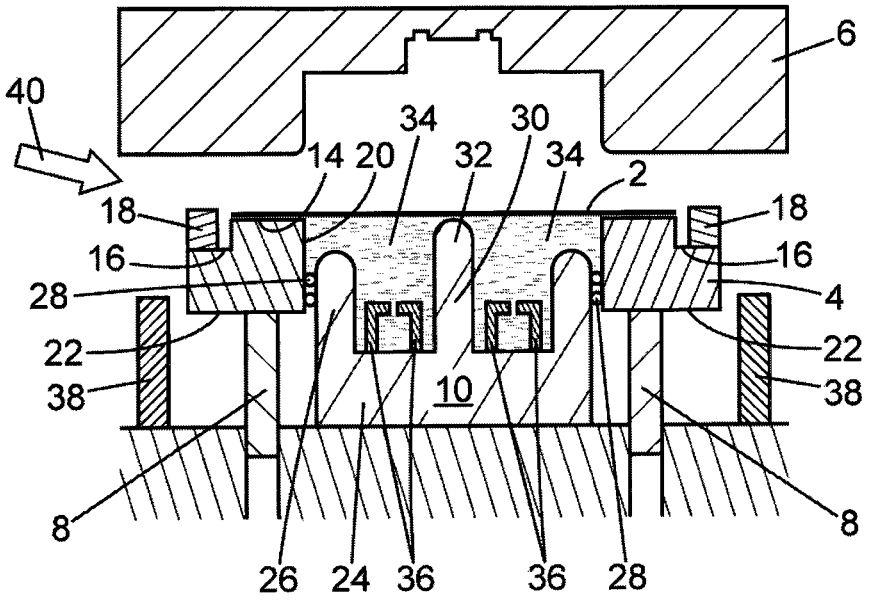
FIG. 1 shows a first step of a hybrid method for forming a sheet, the method being implemented with a hybrid forming device.

The drawing and the description hereinafter contain, essentially, elements of a certain nature. They can therefore not only serve to better explain the present disclosure, but also contribute to the definition thereof, where applicable.

FIG. 1 represents a device for forming a material blank in a longitudinal cross-section through a vertical plane. It is assumed hereinafter in the description that the material blank to be deformed is a sheet 2, made of steel or of steel-based alloy, or indeed of another metal or metal alloy. Initially (FIG. 1), this sheet 2 is of a given shape, for example planar as illustrated in FIG. 1. A cap-shaped sheet for example could also be envisaged.

The sheet 2 to be deformed is placed here between a blank-holder 4 and a die 6. The blank-holder 4 is borne by stays 8 guided in housings formed in a bottom frame placed on the ground assumed to be horizontal and whereon a tank 10 is securely attached.

It is assumed hereinafter in the description that the stays 8 extend vertically and that they support the blank-holder 4 which is therefore located above the stays 8. In this way, a top-down orientation is defined. It will be retained throughout the remainder of the present description.

The blank-holder 4 is disposed here below the sheet 2. It consists of an annular part having a top edge 14 adapted to the die 6 and to the shape to be adopted by the sheet 2 after a first deformation (optional preforming operation described hereinafter).

Around the top edge 14, the blank-holder 4 has a peripheral rim 16 serving as a support for compensating devices 18 intended to cooperate with the die 6 in order to control the clamping forces exerted by the die 6 and the blank-holder 4 on the sheet 2.

In the preferred embodiment illustrated in the drawing, the blank-holder 4 has a cylindrical surface 20, having a cross-section adapted to the shape of the tank 10, of vertical axis. As explained hereinafter, this cylindrical surface 20 makes it possible to create a seal between the blank-holder 4 and the tank 10.

The blank-holder 4 further has a bottom base 22 which rests on the stays 8. The latter are used to support the blank-holder 4. They could also help guide the blank-holder 4 with respect to the tank 10. These stays can be for example gas springs or hydraulic cylinders. They may consist of rods mounted on hydraulic buffers. To guide the assembly formed by the blank-holder 4, the die 6 and the sheet 2 clamped between these two elements in translation with respect to the tank 10, external guiding means, not shown for drawing simplification purposes, are preferably provided.

The die 6 is the main part of the device which determines the final shape of the sheet 2 after deformation. The bottom face of the die 6, i.e. that facing the blank-holder 4, is intended to give the final shape of the sheet 2 after deformation. In the forming method, the sheet 2 will be pushed against the die 6, more specifically against the bottom face of the die 6, to be plastically deformed and mould the shape thereof.

The bottom face of the die 6, which corresponds to the face of the die 6 located facing, on one hand, the blank-holder 4 and, on the other, the tank 10, also includes an annular zone disposed opposite the top edge 14 of the blank-holder 4. The edge of the sheet 2 will be held during the forming method between the top edge of the blank-holder 4 and the abovementioned annular zone of the bottom face of the die 6.

In the illustrated embodiment wherein it was considered that the tank 10 was stationary, the die 6 is movable in a vertical translation movement so as to be able to move towards and away from the blank-holder 4 which initially is intended to remain stationary. The blank-holder 4 remaining stationary, the die 6 moves between the first position, or open position, wherein the free space between the blank-holder 4 and the die 6 is sufficient to insert a sheet 2 before deformation and remove it after deformation, and a second position, or closed position, wherein it grips the peripheral edge of the sheet 2 to be deformed between the annular zone thereof and the top edge 14 of the blank-holder 4. The compensating devices 18 provide a constant gap between the die 6 and the blank-holder 4 corresponding to the thickness of the sheet 2, plus or minus an adjustment value.

For simplification purposes, the drawing does not show the means used for moving the die 6. Such means are known to a person skilled in the art of conventional stamping for example.

The tank 10 fulfils here, in this preferred embodiment, the dual function of receptacle for containing liquid (preferably water) and of punch. It is hereinafter referred to as "tank" but could also be referred to as "punch". Alternatively, these two functions could be separated, a separate punch being for example associated with a tank. This tank 10 has in the illustrated embodiment a base plate 24 from which a peripheral wall 26 extends. The base plate 24 forms the bottom of the tank 10.

The peripheral wall 26 extends vertically and defines with the base plate 24 (which extends substantially horizontally) a cavity capable of being filled with liquid (generally water). The outer surface of the peripheral wall 26 cooperates with the cylindrical surface 20 of the blank-holder to provide tightness, for example using a seal 28, during a vertical translation movement of the blank-holder 4 around the peripheral wall 26. Specific means, for example guiding columns not shown, preferably provide the guidance during a translation movement of the blank-holder 4 with respect to the tank 10. It is noted that the cylindrical surface 20 can form the top edge of the cavity defined by the tank 10 and thus extend this cavity according to the relative position of the blank-holder 4 with respect to the tank 10.

In the illustrated embodiment, the top part of the tank 10 as mentioned above forms at least partially the top face of the punch. Firstly, the free edge (opposite the base plate 24) of the peripheral wall 26 has a contour of shape adapted to the deformation sought to be applied to the sheet 2. This free edge can thus include protruding and/or hollowed parts. Then, a wall 30, substantially vertical, is disposed in the tank 10, inside the peripheral wall 26. This wall 30 starts from the base plate 24 and extends vertically towards the die 6. The free end of the wall 30 forms a head 32 which is machined according to the shape to be given to the sheet 2.

The wall 30 preferably divides the internal cavity of the tank into compartments 34. The compartments can be tight with respect to each other but communications (passages) can be provided therebetween.

Obviously, according to the final shape to be given to the sheet 2, several walls 30 can be provided in the tank. They can be parallel with respect to each other, intersect perpendicularly or according to any angle, and more generally be of any shape: straight, curved, undulated, etc.

In each compartment 34, or at the very least in at least some thereof, a pair of electrodes 36 are disposed which are powered for example through the base plate 24 (connections and insulators not shown).

The presence of DH stops 38 is observed in the drawing, i.e. Die Height stops, which, in a manner known to a person skilled in the art, precisely limit the end of travel of the die 6 (and also of the assembly formed by the blank-holder and the sheet 2 actuated by the die 6 during the movement thereof). The DH stops are disposed on a stationary surface such as for example here a top face of the bottom frame bearing the tank 10, around the peripheral wall 26 and are disposed between this base plate 24 and the bottom face of the die 6. They could also cooperate with the bottom base 22 of the blank-holder 4.

FIG. 1 shows the hybrid forming device in a position corresponding to a first step of a forming method. In this position, the die 6 is in the open position, i.e. in the farthest position thereof from the blank-holder 4 (and from the tank 10 including the punch 26, 32). As mentioned above, the blank-holder 4 and the die 6 are then quite spaced from each other to enable particularly the insertion of a sheet 2 therebetween. FIG. 1 illustrates the positioning of this sheet 2, this positioning being suggested by the arrow 40 on the left of this FIG. 1.

In the position in FIG. 1, the blank-holder 4 is in a high position, i.e. a position wherein the blank-holder 4 bearing the sheet 2 is positioned in such a way that the top part of the tank 10 forming the punch cannot come into contact with the sheet 2. Water can already be present in the compartments 34 of the tank 10. The die 6 is disposed above the sheet 2.

Figure 2:
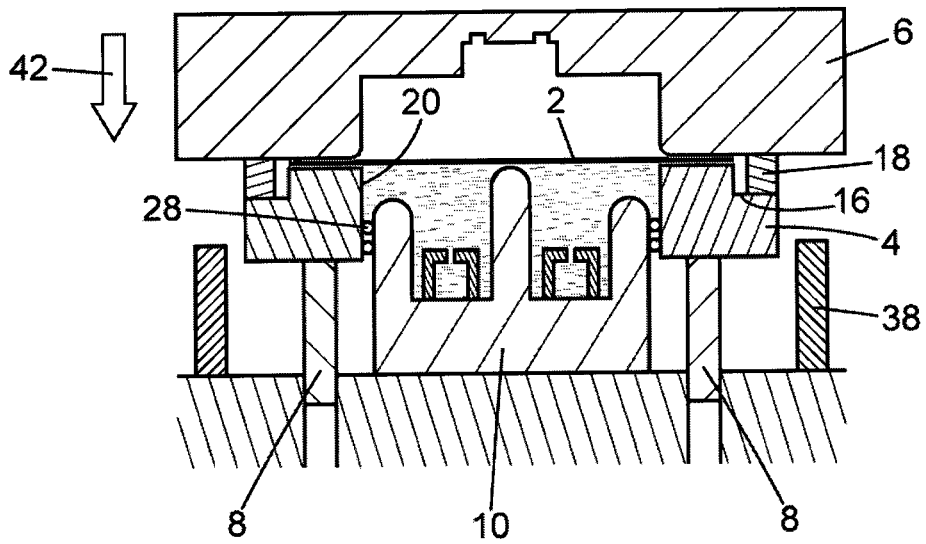
FIG. 2 shows a second step of a hybrid method for forming a sheet, the method being implemented with a hybrid forming device.

FIG. 2 illustrates a subsequent step. With respect to FIG. 1, the die 6 is lowered as suggested by an arrow 42. The peripheral edge of the sheet 2 is gripped between the annular zone of the die 6 and the top edge of the blank-holder 4. The clamping force between the die 6 and the blank-holder 4 is set by compensating devices 18 which are disposed between the peripheral rim 16 of the blank-holder 4 and an edge of the die 6 (also accounting for force compensation which can be carried out at the level of each of the stays 8). In the method illustrated in the drawing, deformation of the sheet 2 is not provided during this step. The contact zones, on one hand, between the sheet 2 and the die 6 and, on the other, between the sheet 2 and the blank-holder 4 are preferably parallel.

Alternatively, the clamping of the die 6 on the sheet 2 could be used in order to carry out a first preforming of the sheet 2, for example to curve the latter and/or to mould the edge thereof. It is thus possible to induce (optionally) a first deformation on the sheet 2. The clamping of the die 6 on the blank-holder 4 furthermore makes it possible to ensure water-tightness between the sheet 2 and the blank-holder 4. A peripheral rod can also optionally be formed on the sheet 2 between the die 6 and the blank-holder 4 to ensure satisfactory tightness between the sheet 2 and the blank-holder 4. An elastomer seal can also fulfil this tightness function.

Water then fills the entire space delimited by the inside of the tank 10, the sheet 2, the cylindrical surface 20 of the blank-holder 4 and the seal(s) 28. The aim of filling with water is to fill the cavity in such a way that the liquid comes into contact with the optionally preformed sheet 2. It can be carried out for example by sucking in the air located below the sheet 2. Simultaneous suction of the air above the sheet 2 is also carried out to maintain substantially the same pressure on both sides of the sheet 2. The suction of air between the sheet 2 and the die 6 is preferably maintained throughout the deformation method to prevent the air located in this space from impeding the deformation of the sheet 2. Alternatively, it can be arranged to discharge the air via discharge holes at a high point of the blank-holder 4 when water rises in the cavity. During this phase, if the sheet has a concave shape, pressurised air can be used to keep the sheet concave, thus limiting the air bubbles below it. The blank-holder 4 remains during this filling in the same position as in FIG. 1.

Figure 3:
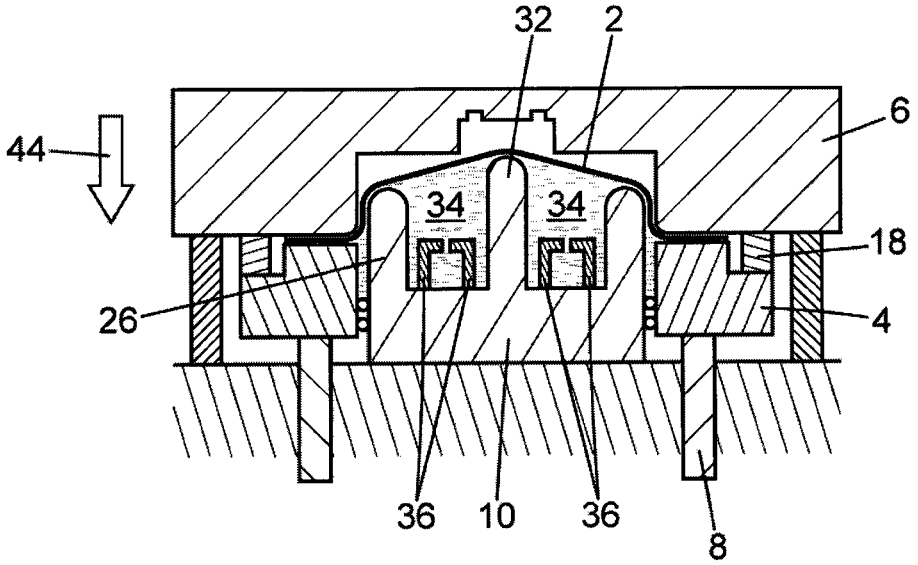
FIG. 3 shows a third step of a hybrid method for forming a sheet, the method being implemented with a hybrid forming device.

Subsequently (FIG. 3), the die 6 continues to descend towards the tank 10, and induces the descent of the blank-holder 4 with respect to the tank 10-arrow 44. The punch formed by the tank 10, more particularly the top peripheral edge of the peripheral wall 26 and the head(s) 32 then come into contact with the sheet 2 and deform it plastically by stretching. During this movement, the punch exerts a force pushing the sheet 2 towards the die 6. The sheet 2 held between the blank-holder 4 and the die 6 is disposed between the punch and the die 6. The punch and/or the tank 10 act as a male part cooperating with the die 6, a female part which here has a housing to receive the punch formed by the top part of the tank 10. The compensating devices 18 act here to regulate the tension at the edge of the sheet 2 and allow if required a movement of material from the sheet 2 towards the inside of the system.

A second deformation step (the optional preforming mentioned above being the first deformation step) of the sheet 2 is carried out here. It consists here of a stamping step. During this deformation step, it is sought preferably, but not obligatorily, to ensure that the sheet 2 does not touch the die 6 in the central zone thereof, i.e. in the zone located facing the inside of the peripheral wall 26. However, in some cases, a "full" deformation of the sheet 2 can be provided at certain locations during this stamping operation. This makes it possible to avoid having to provide electrodes to "cover" the entire surface of the sheet 2.

Figure 4:
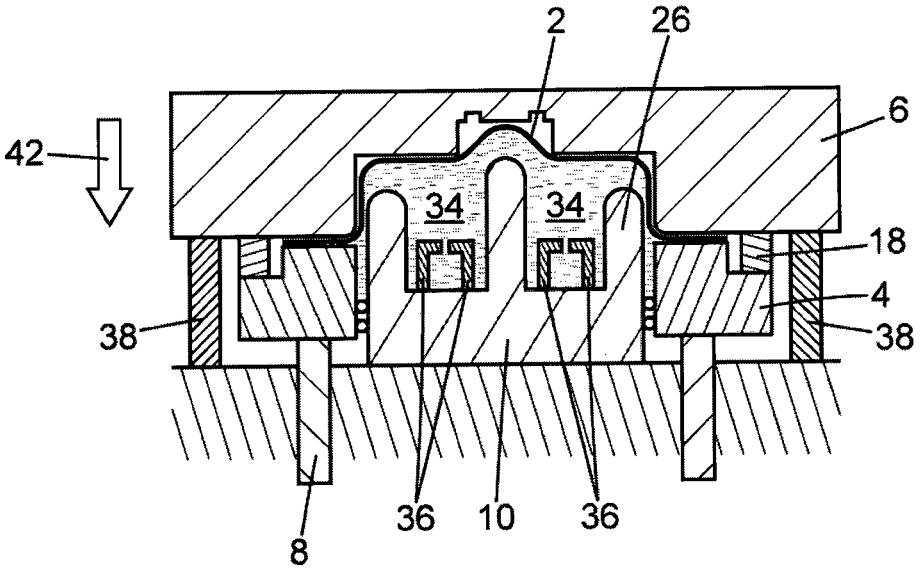
FIG. 4 shows a fourth step of a hybrid method for forming a sheet, the method being implemented with a hybrid forming device.

FIG. 4 illustrates an advantageous but optional step of the hybrid forming method. It is proposed here to have a step of quasi-static hydroforming of the sheet 2 during which this sheet 2 once again approaches the die 6 and can locally come into contact therewith. This deformation of the sheet 2 is then obtained by pressurising the water located in the tank 10, for example by acting upon the die 6 (arrow 42). The sheet 2 is therefore separated at least locally from the punch formed by the top part of the tank 10 and adopts an intermediate position between the die 6 and the head(s) 32 and the top edge of the peripheral wall 26 forming the punch.

A person skilled in the art will already have observed that the appended figures are schematic and merely illustrative. The deformations and the details are not to scale.

Figure 5:
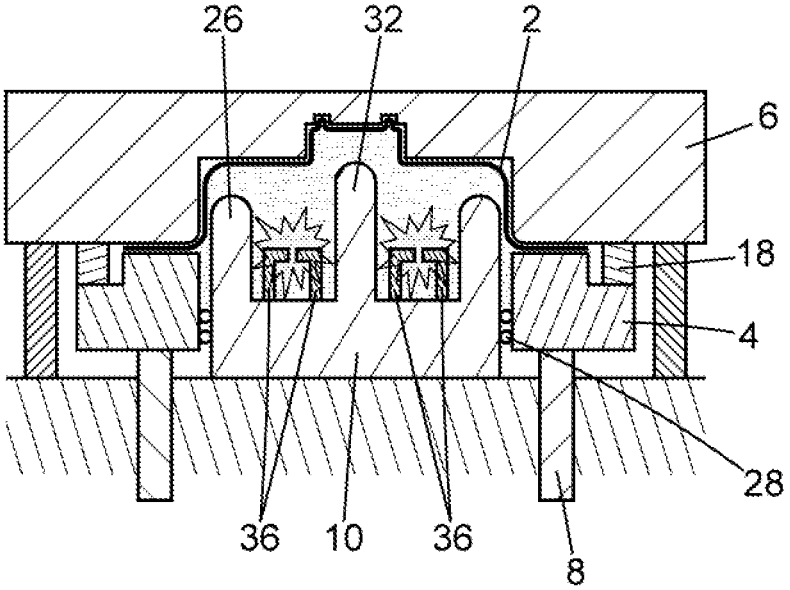
FIG. 5 shows a fifth step of a hybrid method for forming a sheet, the method being implemented with a hybrid forming device.

FIG. 5 illustrates a subsequent step of the method for forming the sheet 2. An electro-hydroforming is shown schematically here. A discharge chamber is formed here and entirely filled with water. It comprises the cavity inside the tank and extends beyond up to the deformed sheet 2 and up to the seal created between the tank and the blank-holder 4. The pairs of electrodes 36, disposed in said discharge chamber, are then powered by a strong current from a capacitor discharge. In a known manner, this electrical discharge creates in the liquid (water) contained in the tank 10 and in contact with the sheet 2 (it is important to have a satisfactory filling of water in the tank 10 such that the water is indeed in contact with the sheet 2 for this electro-hydroforming step) an explosion creating a shock wave which is propagated towards the sheet 2. The wall(s) 30 and the peripheral wall 26 guide the shock waves and thus act to enable a satisfactory deformation of the sheet 2 against the die 6.

In this method, a single electrical discharge in the pairs of electrodes 36 is normally sufficient to obtain the sought deformation thanks to the prior deformations of the sheet 2, before the electro-hydroforming step.

The drawing does not represent the final steps which relate to the removal of the part which was formed from the sheet 2, with opening of the mould and relowering of the tank to the position thereof illustrated in FIG. 1.

The method described here therefore makes it possible to produce parts with a reduced cycle time as a single electro-hydroforming step is required. The stretch drawing and optionally hydroforming operations are carried out virtually in masked time.

A great advantage of the method described here is that the sheet after deformation can have vertical walls (within the clearance angle to be able to separate the sheet formed from the die 6 at the end of the process), in other words, the part obtained by deforming the sheet can have faces which extend substantially perpendicularly to the orientation of the sheet before deformation. In the example illustrated in the drawing, the sheet is initially in a horizontal plane. After deformation, it can then have quasi-vertical faces (before removing the part from the system).

The forming method and the hybrid forming device proposed here make it possible to obtain by electro-hydroforming parts with quasi-vertical walls with a reduced cycle time. The cost price of such parts can thus be limited.

According to an alternative embodiment, the walls in the tank (the punch) could for example form a honeycomb type cellular structure.

It is arranged in the embodiment illustrated that the peripheral wall of the tank is a part of the punch intended to deform the sheet by stamping. This depends obviously on the sought shape to be given to the sheet. The peripheral wall of the tank is not necessarily part of the punch. It could for example be arranged in FIG. 3 that the blank-holder is flush with the top edge of the peripheral wall of the tank.

In the device shown, it has been assumed that the tank was stationary. This is a preferred embodiment but it would be possible to have a stationary die. A person skilled in the art understands that it is the relative movement between the various constituent elements of the system which is important.

The present disclosure is not limited to the different embodiments described and illustrated and to the alternative embodiments mentioned but it also relates to embodiments within the grasp of a person skilled in the art.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A method for forming a material blank, comprising:

placing the material blank to be deformed between a die and a blank-holder, wherein a face of the die facing the blank-holder is intended to give a final shape to the material blank;

deforming the material blank by stamping using at least one punch that exerts a force pushing the material blank toward the die, in order to obtain a pre-stamped material blank;

filling a cavity with a liquid, the cavity at least partially defined by the at least one punch, at least one pair of electrodes being located in the cavity and the pre-stamped material blank being in contact with the liquid in the cavity; and deforming the pre-stamped material blank against the die by generating at least one electrical discharge between the at least one pair of electrodes.

2. The method according to claim 1, wherein by deforming the material blank by stamping, a relative travel of each of the at least one punch with respect to the die is limited in such a way that the material blank does not come into contact with the die when it is pushed by the at least one punch.

3. The method according to claim 1, wherein by deforming the material blank by stamping, a relative travel of the at least one punch with respect to the die allows the material blank to come into contact with the die when it is pushed by said at least one punch.

4. The method according to claim 1, wherein the deforming the pre-stamped material blank includes pressurizing the liquid in contact with the pre-stamped material blank.

5. The method according claim 1, further comprising creating a vacuum between the material blank and the die.

6. The method according to claim 1, further comprising moving the at least one punch away from the die only after the generating the at least one electrical discharge.

7. The method according to claim 1, wherein the die is disposed above the material blank, wherein the die is lowered and a peripheral edge of the material blank is gripped between an annular zone of the die and a top edge of the material blank, wherein the die continues to descend toward the cavity and induces a descent of the blank-holder with respect to the cavity, and during the descent the at least one punch deforms the material blank towards the die, wherein the punch acts as a male part cooperating with the die, a female part of which having a housing to receive the punch.

8. A hybrid forming device of a material blank, comprising:

a die cooperating with a blank-holder, the die being movable relative to the blank-holder between an open position in which the material blank can be positioned between the die and the blank-holder and can be removed therefrom and a closed position in which the blank-holder cooperates with the die to hold in a controlled manner an edge of the material blank to be deformed, wherein a face of the die facing the blank-holder is intended to give a final shape to the material blank;

a tank at least partially defining a cavity capable of being filled with a liquid; and at least two electrodes in the cavity, wherein the tank includes at least one movable punch relative to an assembly formed by the blank-holder and the die in the closed position between a far position in which a free end of the punch is at a distance from the die and a near position in which the free end of the punch is at a distance from the die less than the distance thereof in the far position, wherein the punch is able to push the material blank toward the die.

9. The hybrid forming device according to claim 8, wherein the assembly formed by the blank-holder and the die in the closed position is movable with respect to the tank which remains stationary.

10. The hybrid forming device according to claim 8, wherein the tank has a bottom and a peripheral wall, and a free edge of the peripheral wall forms a punch.

11. The hybrid forming device according to claim 8, wherein the tank has a bottom and a peripheral wall, the at least one punch is produced on a free edge of a wall extending through the tank by dividing the latter into at least two compartments, and the at least two electrodes includes at least one pair of electrodes located in each of the two compartments.

12. The hybrid forming device according to claim 8, wherein the blank-holder is attached to vertical stays, the die is movably mounted in translation with respect to the blank-holder on a side opposite the stays, the tank includes a bottom and a peripheral wall, and the tank is fixedly mounted whereas the stays are sliding with respect to the tank.

* * * * *